US007383178B2

(12) United States Patent
Visser et al.

(10) Patent No.: US 7,383,178 B2
(45) Date of Patent: Jun. 3, 2008

(54) SYSTEM AND METHOD FOR SPEECH PROCESSING USING INDEPENDENT COMPONENT ANALYSIS UNDER STABILITY CONSTRAINTS

(75) Inventors: Erik Visser, San Diego, CA (US); Te-Won Lee, San Diego, CA (US)

(73) Assignee: SoftMax, Inc., San Diego, CA (US)

( * ) Notice: Subject to any disclaimer, the term of this patent is extended or adjusted under 35 U.S.C. 154(b) by 50 days.

(21) Appl. No.: 10/537,985

(22) PCT Filed: Dec. 11, 2003

(86) PCT No.: PCT/US03/39593

§ 371 (c)(1),
(2), (4) Date: Jun. 9, 2005

(87) PCT Pub. No.: WO2004/053839

PCT Pub. Date: Jun. 24, 2004

(65) Prior Publication Data

US 2006/0053002 A1 Mar. 9, 2006

Related U.S. Application Data

(60) Provisional application No. 60/432,691, filed on Dec. 11, 2002.

(51) Int. Cl.
*G10L 21/02* (2006.01)

(52) U.S. Cl. ..... 704/227

(58) Field of Classification Search ..... None
See application file for complete search history.

(56) References Cited

U.S. PATENT DOCUMENTS 4,649,505 A 3/1987 Zinser, Jr. et al.

(Continued)

FOREIGN PATENT DOCUMENTS

EP 1 006 652 A2 6/2000

(Continued)

OTHER PUBLICATIONS

Amari, et al. 1997. Stability analysis of learning algorithms for blind source separation. *Neural Networks*, 10(8):1345-1351.

(Continued)

*Primary Examiner*—Donald L. Storm
(74) *Attorney, Agent, or Firm*—Knobbe Martens Olson & Bear LLP

(57) ABSTRACT

A system and method for separating a mixture of audio signal into desired audio signals (430) (e.g., speech) and a noise sign (440) is disclosed. Microphones (310, 320) are positioned to receive the mixed audio signals, and an independent component analysis (ICA) processes (212) the sound mixture using stability constraints. The ICA process (508) uses predefined characteristics of the desired speech signal to identify and isolate a target sound signal (430). Filter coefficients are adapted with a learning rule and filter weight update dynamics are stabilized to assist convergence to a stable separated ICA signal result. The separated signals may be peripherally-processed to further reduce noise effects using post-processing (214) and pre-processing (220, 230) techniques and information. The proposed system is designed and easily adaptable for implementation on DSP units or CPUs in audio communication hardware environments.

50 Claims, 8 Drawing Sheets

U.S. PATENT DOCUMENTS

| | | | | |
|---|---|---|---|---|
| 4,912,767 | A | 3/1990 | Chang | |
| 5,208,786 | A | 5/1993 | Weinstein et al. | |
| 5,251,263 | A | 10/1993 | Andrea et al. | |
| 5,327,178 | A | 7/1994 | McManigal | |
| 5,375,174 | A | 12/1994 | Denenberg | |
| 5,383,164 | A * | 1/1995 | Sejnowski et al. | 367/134 |
| 5,706,402 | A * | 1/1998 | Bell | 706/22 |
| 5,770,841 | A * | 6/1998 | Moed et al. | 235/375 |
| 5,999,567 | A | 12/1999 | Torkkola | |
| 5,999,956 | A | 12/1999 | Deville | |
| 6,002,776 | A * | 12/1999 | Bhadkamkar et al. | 381/66 |
| 6,108,415 | A | 8/2000 | Andrea | |
| 6,130,949 | A | 10/2000 | Aoki et al. | |
| 6,167,417 | A | 12/2000 | Parra et al. | |
| 6,381,570 | B2 | 4/2002 | Li et al. | |
| 6,424,960 | B1 * | 7/2002 | Lee et al. | 706/20 |
| 6,526,148 | B1 * | 2/2003 | Jourjine et al. | 381/94.7 |
| 6,549,630 | B1 | 4/2003 | Bobisuthi | |
| 6,606,506 | B1 | 8/2003 | Jones | |
| 7,099,821 | B2 | 8/2006 | Visser et al. | |
| 2001/0037195 | A1 | 11/2001 | Acero et al. | |
| 2002/0110256 | A1 * | 8/2002 | Watson et al. | 381/389 |
| 2002/0136328 | A1 * | 9/2002 | Shimizu | 375/316 |
| 2002/0193130 | A1 | 12/2002 | Yang et al. | |
| 2003/0055735 | A1 | 3/2003 | Cameron et al. | |
| 2003/0179888 | A1 | 9/2003 | Burnett et al. | |
| 2004/0039464 | A1 | 2/2004 | Virolainen et al. | |
| 2004/0120540 | A1 | 6/2004 | Mullenborn et al. | |
| 2004/0136543 | A1 | 7/2004 | White et al. | |

FOREIGN PATENT DOCUMENTS

| | | | | |
|---|---|---|---|---|
| WO | WO 01/27874 | * 4/2001 | | 706/20 |
| WO | WO 06/012578 | 2/2006 | | |
| WO | WO 06/028587 | 3/2006 | | |

OTHER PUBLICATIONS

Hyvärinen, A. 1999. Fast and robust fixed-point algorithms for independent component analysis. *IEEE Trans. on Neural Networks*, 10(3):626-634.

First Examination Report dated Oct. 23, 2006 from Indian Application No. 1571/CHENP/2005.

Murata, Ikeda. 1998. An On-line Algorithm for Blind Source Separation on Speech Siganls. *Proc. of* 1998 *International Symposium on Nonlinear Theory and its Application* (NOLTA98), pp. 923-926, Le Regent, Crans-Montana, Switzerland.

International Search Report from the EPO, Reference No. P400550, dated Oct. 15, 2007, in regards to European Publication No. EP1570464.

Amari, et al. 1996. A new learning algorithm for blind signal separation. In D. Touretzky, M. Mozer, and M. Hasselmo (Eds.), *Advances in Neural Information Processing Systems* 8 (pp. 757-763). Cambridge: MIT Press.

Bell, et al. 1995. An information-maximization approach to blind separation and blind deconvolution. *Neural Computation*, 7:1129-1159.

Cardoso, J-F. 1992. Fourth-order cumulant structure forcing. Application to blind array processing. *Proc. IEEE SP Workshop on SSAP*-92, 136-139.

Comon, P. 1994. Independent component analysis, A new concept? *Signal Processing*, 36:287-314.

Griffiths, et al. 1982. An alternative approach to linearly constrained adaptive beamforming. *IEEE Transactions in Antennas and Propagation*, AP-30(1):27-34.

Herault, et al. 1986. Space or time adaptive signal processing by neural network models. Neural Networks for Computing. In J. S. Denker (Ed.), *Proc. of the AIP Conference* (pp. 206-211). New York: American Institute of Physics.

Hoshuyama, et al. 1999. A robust adaptive beamformer for microphone arrays with a blocking matrix using constrained adaptive filters. *IEEE Transactions on Signal Processing*, 47(10):2677-2684.

Hyvärinen, et al. 1997. A fast fixed-point algorithm for independent component analysis. *Neural Computation*, 9:1483-1492.

Jutten, et al. 1991. Blind separation of sources, Part I: An adaptive algorithm based on neuromimetic architecture. *Signal Processing*, 24:1-10.

Lambert, R. H. 1996. Multichannel blind deconvolution: FIR matrix algebra and separation of multipath mixtures. Doctoral Dissertation, University of Southern California.

Lee, et al. 1997. A contextual blind separation of delayed and convolved sources. *Proceedings of the 1997 IEEE International Conference on Acoustics, Speech, and Signal Processing* (ICASSP '97), 2:1199-1202.

Lee, et al. 1998. Combining time-delayed decorrelation and ICA: Towards solving the cocktail party problem. *Proceedings of the 1998 IEEE International Conference on Acoustics, Speech, and Signal Processing* (ICASSP'98), 2:1249-1252.

Molgedey, et al. 1994. Separation of a mixture of independent signals using time delayed correlations. *Physical Review Letters, The American Physical Society*, 72(23):3634-3637.

Parra, et al. 2000. Convolutive blind separation of non-stationary sources. *IEEE Tmsactions on Speech and Audio Processing*, 8(3):320-327.

Platt, et al. 1992. Networks for the separation of sources that are superimposed and delayed. In J. Moody. S. Hanson, R. Lippmann (Eds.), *Advances in Neural Information Processing* 4 (pp. 730-737). San Francisco: Morgan-Kaufmann.

Tong, et al. 1991. A necessary and sufficient condition for the blind identification of memoryless systems. *Circuits and Systems, IEEE International Symposium*, 1:1-4.

Torkkola, K. 1996. Blind separation of convolved sources based on information maximization. *Neural Networks for Signal Processing: VI. Proceedings of the 1996 IEEE Signal Processing Society Workshop*, pp. 423-432.

Torkkola, K. 1997. Blind deconvolution, information maximization and recursive filters. *IEEE International Conference on Acoustics, Speech, and Signal Processing* (ICASSP'97), 4:3301-3304.

Van Compernolle, et al. 1992, Signal separation in a symmetric adaptive noise canceler by output decorrelation. *Acoustics, Speech, and Signal Processing*, 1992. ICASSP-92., 1992 *IEEE International Conference*, 4:221-224.

Visser, et al. Blind source separation in mobile environments using a priori knowledge. *Acoustics, Speech, and Signal Processing*, 2004. *Proceedings*. (ICASSP '04). *IEEE International Conference on*, vol. 3, May 17-21, 2004, pp. iii-893-896.

Visser, et al. Speech enhancement using blind source separation and two-channel energy based speaker detection. *Acoustics, Speech, and Signal Processing*, 2003. *Proceedings*. (ICASSP '03). 2003 *IEEE International Conference on*, vol. 1, Apr. 6-10, 2003, pp. I-884 - I-887.

Yellin, et al. 1996. Mutichannel signal separation: Methods and analysi. *IEEE Transactions on Signal Processing*, 44(1):106-118.

International Search Report from PCT/US03/39593 dated Apr. 29, 2004.

International Preliminary Report on Patentability dated Feb. 1, 2007, with copy of Written Opinion of ISA dated Apr. 19, 2006, for PCT/US2005/026195 filed on Jul. 22, 2005.

International Preliminary Report on Patentability dated Feb. 1, 2007, with copy of Written Opinion of ISA dated Mar. 10, 2006, for PCT/US2005/026196 filed on Jul. 22, 2005.

Office Action dated Mar. 23, 2007 from co-pending U.S. Appl. No. 11/463,376 filed Aug. 9, 2006.

Office Action dated Jul. 23, 2007 from co-pending U.S. Appl. No. 11/187,504 filed Jul. 22, 2005.

* cited by examiner

800

| | Signal Type | Preferred Processes |
|---|---|---|
| 810 | Heavy Noise + Competing Source | Speech Enhancement + Speech De-noising + Speech Feature Extraction |
| 820 | Competing Source | Speech Enhancement + Speech Feature Extraction |
| 830 | Heavy Noise | Speech De-noising + Speech Feature Extraction |
| 840 | Relatively Clean Speech | Speech Feature Extraction |

SYSTEM AND METHOD FOR SPEECH PROCESSING USING INDEPENDENT COMPONENT ANALYSIS UNDER STABILITY CONSTRAINTS

CROSS REFERENCE TO RELATED APPLICATION

This application claims the benefit and priority to and is a U.S. National Phase of PCT International Application Number PCT/US2003/039593, filed on Dec. 11, 2003, designating the United States of America, which claims priority under 35 U.S.C. § 119 to U.S. Application Number 60/432,691 filed on Dec. 11, 2002.

BACKGROUND OF THE INVENTION

1. Field of the Invention

The present invention relates to systems and methods for audio signal processing, in particular to systems and methods for enhancing speech quality in an acoustic environment.

2. Description of the Related Art

Speech signal processing is important in many areas of everyday communication, particularly in those areas where noises are profuse. Noises in the real world abound from multiple sources, including apparently single source noises, which in the real world transgress into multiple sounds with echoes and reverberations. Unless separated and isolated, it is difficult to extract the desired noise from background noise. Background noise may include numerous noise signals generated by the general environment, signals generated by background conversations of other people, as well as the echoes, reflections, and reverberations generated from each of the signals. In communication where users often talk in noisy environments, it is desirable to separate the user's speech signals from background noise. Speech communication mediums, such as cell phones, speakerphones, headsets, hearing aids, cordless telephones, teleconferences, CB radios, walkie-talkies, computer telephony applications, computer and automobile voice command applications and other hands-free applications, intercoms, microphone systems and so forth, can take advantage of speech signal processing to separate the desired speech signals from background noise.

Many methods have been created to separate desired sound signals from background noise signals. Prior art noise filters identify signals with predetermined characteristics as white noise signals, and subtract such signals from the input signals. These methods, while simple and fast enough for real time processing of sound signals, are not easily adaptable to different sound environments, and can result in substantial degradation of the speech signal sought to be resolved. The predetermined assumptions of noise characteristics can be over-inclusive or under-inclusive. As a result, portions of a person's speech may be considered "noise" by these methods and therefore removed from the output speech signals, while portions of background noise such as music or conversation may be considered non-noise by these methods and therefore included in the output speech signals.

Other more recently developed methods, such as Independent Component Analysis ("ICA"), provide relatively accurate and flexible means for the separation of speech signals from background noise. For example, PCT publication WO 00/41441 discloses using a specific ICA technique to process input audio signals to reduce noise in the output audio signal. ICA is a technique for separating mixed source signals (components) which are presumably independent from each other. In its simplified form, independent component analysis operates an "un-mixing" matrix of weights on the mixed signals, for example multiplying the matrix with the mixed signals, to produce separated signals. The weights are assigned initial values, and then adjusted to maximize joint entropy of the signals in order to minimize information redundancy. This weight-adjusting and entropy-increasing process is repeated until the information redundancy of the signals is reduced to a minimum. Because this technique does not require information on the source of each signal, it is known as a "blind source separation" method ("BSS"). Blind separation problems refer to the idea of separating mixed signals that come from multiple independent sources.

One of the earliest discussions of ICA is that by Tony Bell in U.S. Pat. No. 5,706,402 which spawned further research. There are now many different ICA techniques or algorithms. A summary of the most widely used algorithms and techniques can be found in books and references therein about ICA (e.g Te-Won Lee, Independent Component Analysis: Theory and Applications, Kluwer Academic Publishers, Boston, September 1998, Hyvarinen et al., Independent Component Analysis, 1st edition (Wiley-Interscience, May 18, 2001); Mark Girolami, Self-Organizing Neural Networks: Independent Component Analysis and Blind Source Separation (Perspectives in Neural Computing) (Springer Verlag, September 1999); and Mark Girolami editor), Advances in Independent Component Analysis (Perspectives in Neural Computing) (Springer Verlag August 2000). Singular value decomposition algorithms have been disclosed in Adaptive Filter Theory by Simon Haykin (Third Edition, Prentice-Hall (NJ), (1996).

Many popular ICA algorithms have been developed to optimize their performance, including a number which have evolved by significant modifications of those which only existed a decade ago. For example, the work described in A. J. Bell and T J Sejnowski, Neural Computation 7:1129-1159 (1995), and Bell, A. J. U.S. Pat. No. 5,706,402, is usually not used in its patented form. Instead, in order to optimize its performance, this algorithm has gone through several recharacterizations by a number of different entities. One such change includes the use of the "natural gradient", described in Amari, Cichocki, Yang (1996). Other popular ICA algorithms include methods that compute higher-order statistics such as cumulants (Cardoso, 1992; Comon, 1994; Hyvaerinen and Oja, 1997).

However, many known ICA algorithms are not able to effectively separate signals that have been recorded in a real environment which inherently include acoustic echoes, such as those due to room reflections. It is emphasized that the methods mentioned so far are restricted to the separation of signals resulting from a linear stationary mixture of source signals. The phenomenon resulting from the summing of direct path signals and their echoic counterparts is termed reverberation and poses a major issue in artificial speech enhancement and recognition systems. Presently, ICA algorithms require include long filters which can separate those time-delayed and echoed signals, thus precluding effective real time use.

FIG. 1 shows one embodiment of a prior art ICA signal separation system 100. In such a prior art system, a network of filters, acting as a neural network, serve to resolve individual signals from any number of mixed signals inputted into the filter network. As shown in FIG. 1, the system 100 includes two input channels 110 and 120 that receive input signals $X_1$ and $X_2$. For signal $X_1$, an ICA direct filter $W_1$ and an ICA cross filter $C_2$ are applied. For signal $X_2$, an ICA direct filter $W_2$ and an ICA cross filter $C_1$ are applied. The direct filters $W_1$ and $W_2$ communicate for direct adjustments. The cross filters are feedback filters that merge their respective filtered signals with signals filtered by the direct filters. After convergence of the ICA filters, the produced output signals $U_1$ and $U_2$ represent the separated signals.

U.S. Pat. No. 5,675,659, Torkkola et al., proposes methods and an apparatus for blind separation of delayed and filtered sources. Torkkola suggests an ICA system maximizing the entropy of separated outputs but employing unmixing filters instead of static coefficients like in Bell's patent. However, the ICA calculations described in Torkkola to calculate the joint entropy and to adjust the cross filter weights are numerically unstable in the presence of input signals with time-varying input energy like speech signals and introduce reverberation artifacts into the separated output signals. The proposed filtering scheme therefore does not achieve stable and perceptually acceptable blind source separation of real-life speech signals.

Typical ICA implementations also face additional hurdles as requiring substantial computing power to repeatedly calculate the joint entropy of signals and to adjust the filter weights. Many ICA implementations also require multiple rounds of feedback filters and direct correlation of filters. As a result, it is difficult to accomplish ICA filtering of speech in real time and use a large number of microphones to separate a large number of mixed source signals. In the case of sources originating from spatially localized locations, the un-mixing filter coefficients can be computed with a reasonable amount of filter taps and recording microphones. However if the source signals are distributed in space like background noise originating from vibrations, wind noise or background conversation, the signals recorded at microphone locations emanate from many different directions requiring either very long and complicated filter structures or a very large number of microphones. Since any real-life system is limited in processing power and hardware complexity, an additional processing approach has to complement the discussed ICA filter structure to provide a robust methodology for real-time speech signal enhancement. The computational complexity of such a system should be compatible with the processing power of small consumer devices such as cell phones, Personal Digital Assistants (PDAs), audio surveillance devices, radios, and the like.

What is desired is a simplified speech processing method that can separate speech signals from background noise in real-time and does not require substantial computing power, but still produce relatively accurate results and can adapt flexibly to different environments.

SUMMARY OF THE INVENTION

The present invention relates to systems and methods for speech processing useful to identify and separate desired audio signal(s), such as at least one speech signal, in a noisy acoustic environment. The speech process operates on a device(s) having at least two microphones, such as a wireless mobile phone, headset, or cell phone. At least two microphones are positioned on the housing of the device for receiving desired signals from a target, such as speech from a speaker. The microphones are positioned to receive the target user's speech, but also receive noise, speech from other sources, reverberations, echoes, and other undesirable acoustic signals. At least both microphones receive audio signals that include the desired target speech and a mixture of other undesired acoustic information. The mixed signals from the microphones are processed using a modified ICA (independent component analysis) process. The speech process uses a predefined speech characteristic, which has been predefined, to assist in identifying the speech signal. In this way, the speech process generates a desired speech signal from the target user, and a noise signal. The noise signal may be used to further filter and process the desired speech signal.

An aspect of the invention relates to a speech separation system that includes at least two channels of input signals, each comprising one or a combination of audio signals, and two improved independent component analysis cross filters. The two channels of input signals are filtered by the cross filters, which are preferably infinitive impulse response filters with nonlinear bounded functions. The nonlinear bounded functions are nonlinear functions with predetermined maximum and minimum values that can be computed quickly, for example a sign function that returns as output either a positive or a negative value based on the input value. Following repeated feedback of signals, two channels of output signals are produced, with one channel containing substantially desired audio signals and the other channel containing substantially noise signals.

One aspect of the invention relates to systems and methods of separating audio signals into desired speech signals and noise signals. Input signals, which are combinations of desired speech signals and noise signals, are received from at least two channels. An equal number of independent component analysis cross filters are employed. Signals from the first channel are filtered by the first cross filter and combined with signals from the second channel to form augmented signals on the second channel. The augmented signals on the second channel are filtered by the second cross filter and combined with signals from the first channel to form augmented signals on the first channel. The augmented signals on the first channel can be further filtered by the first cross filter. The filtering and combining processes are repeated to reduce information redundancy between the two channels of signals. The produced two channels of output signals represent one channel of predominantly speech signals and one channel of predominantly non-speech signals. Additional speech enhancement methods, such as spectral subtraction, Wiener filtering, de-noising and speech feature extraction may be performed to further improve speech quality.

Another aspect of the invention relates to the inclusion of stabilizing elements in the design of the feedback filtering scheme. In one stabilization example, the filter weight adaptation rule is designed in such a manner that the weight adaptation dynamics are in pace with the overall stability requirement of the feedback structure. Unlike previous approaches, the overall system performance is thus not solely directed towards the desired entropy maximization of separated outputs but considers stability constraints to meet a more realistic objective. This objective is better described as a maximum likelihood principle under stability constraint. These stability constraints in maximum likelihood estimation correspond to modeling temporal characteristics of the source signals. In entropy maximization approaches signal sources are assumed i.i.d. (independently, identically drawn) random variables. However, real signals such as sounds and speech signals are not random signals but have correlations in time and are smooth in frequency. This results in a corresponding original ICA filter coefficient learning rule.

In another stabilization example, since this learning rule is directly dependent on the recorded input amplitude, the input channels are scaled down by an adaptive scaling factor to constrain the filter weight adaptation speed. The scaling factor is determined from a recursive equation and is a function of the channel input energy. It is thus unrelated to the entropy maximization of the subsequent ICA filter operations. Furthermore the adaptive nature of the ICA filter structure implies that the separated output signals contain reverberation artifacts if filter coefficients are adjusted too fast or exhibit oscillating behavior. Thus the learned filter weights have to be smoothed in the time and frequency domains to avoid reverberation effects. Since this smoothing operation slows down the filter learning process, this enhanced speech intelligibility design aspect has an additional stabilizing effect on the overall system performance.

To increase performance of blind source separation of spatially distributed background noise which may arise to limitations in computational resources and number of microphones, the ICA computed inputs and outputs can be each pre-process or post-processed, respectively. For example, an alternative embodiment of the present invention contemplates including voice activity detection and adaptive Wiener filtering since these methods exploit solely temporal or spectral information about the processed signals, and would thus complement the ICA filtering unit.

A final aspect of the invention is concerned with computational precision and power issues of the filter feedback structure. In a finite bit precision arithmetic environment (typically 16 bit or 32 bit), the filtering operation is subject to filter coefficient quantization errors. These typically result in deteriorated convergence performance and overall system stability. Quantization effects can be controlled by limiting the cross filter lengths and by changing the original feedback structure so the post-processed ICA output is instead fed back into the ICA filter structure. It is emphasized that the down scaling of input energy in a finite precision environment is not only necessary from a stability point of view, but also because of the finite range of computed numerical values. Although performance in finite precision environments is reliable and adjustable, the proposed speech processing scheme should preferably be implemented in floating point precision environments. Finally implementation under computational constraints is accomplished by appropriately choosing the filter length and tuning the filter coefficient update frequency. Indeed the computational complexity of the ICA filter structure is a direct function of these latter variables.

Other aspects and embodiments are illustrated in drawings, described below in the "Detailed Description" section, or defined by the scope of the claims.

DETAILED DESCRIPTION OF THE PREFERRED EMBODIMENT

Preferred embodiments of a speech separation system are described below in connection with the drawings. In order to enable real-time processing with limited computing power, the system uses an improved ICA processing sub-module of cross filters with simple and easy-to-compute bounded functions. Compared to conventional approaches, this simplified ICA method reduces the computing power requirement and successfully separates speech signals from non-speech signals.

Speech Separation System Overview

Figure 1:
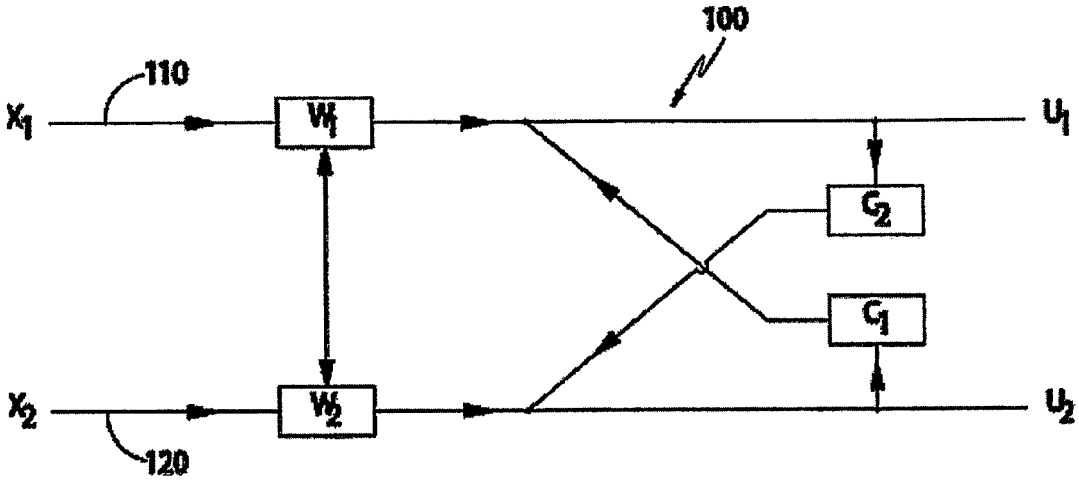
FIG. 1 (PRIOR ART)
FIG. 1 illustrates a block diagram of prior art ICA signal separation systems.
Figure 2:
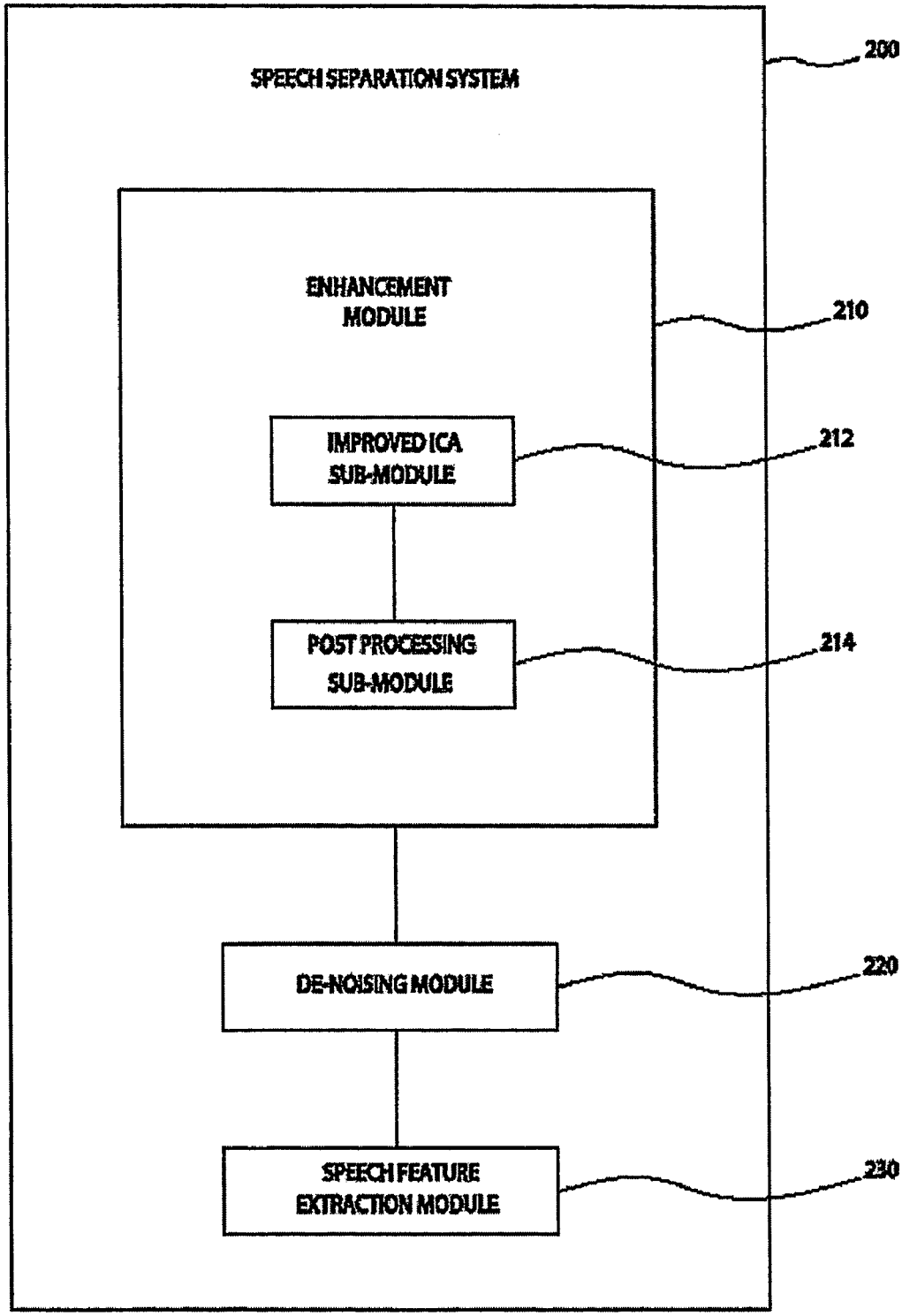
FIG. 2 is a block diagram of one embodiment of a speech separation system in accordance with the present invention FIG. 3 a block diagram of one embodiment of an improved ICA processing sub-module in accordance with the present invention.

FIG. 2 illustrates one embodiment of a speech separation system 200. The system 200 includes a speech enhancement module 210, an optional speech de-noising module 220, and an optional speech feature extraction module 230. The speech enhancement module 210 includes an improved ICA processing sub-module 212 and optionally a post-processing sub-module 214. The improved ICA processing sub-module 212 uses simplified and improved ICA processing to achieve real-time speech separation with relatively low computing power. In applications that do not require real-time speech separation, the improved ICA processing can further reduce the requirement on computing power. As used herein, the terms ICA and BSS are interchangeable and refer to methods for minimizing or maximizing the mathematical formulation of mutual information directly or indirectly through approximations, including time- and frequency-domain based decorrelation methods such as time delay decorrelation or any other second or higher order statistics based decorrelation methods.

As used herein, a "module" or "sub-module" can refer to any method, apparatus, device, unit or computer-readable data storage medium that includes computer instructions in software, hardware or firmware form. It is to be understood that multiple modules or systems can be combined into one module or system and one module or system can be separated into multiple modules or systems to perform the same functions. In preferred embodiments with respect to cell phone applications, the improved ICA processing sub-module 212, in its own or in combination with other modules, is embodied in a microprocessor chip located in a cell phone. When implemented in software or other computer-executable instructions, the elements of the present invention are essentially the code segments to perform the necessary tasks, such as with routines, programs, objects, components, data structures, and the like. The program or code segments can be stored in a processor readable medium or transmitted by a computer data signal embodied in a carrier wave over a transmission medium or communication link. The "processor readable medium" may include any medium that can store or transfer information, including volatile, nonvolatile, removable and non-removable media. Examples of the processor readable medium include an electronic circuit, a semiconductor memory device, a ROM, a flash memory, an erasable ROM (EROM), a floppy diskette or other magnetic storage, a CD-ROM/DVD or other optical storage, a hard disk, a fiber optic medium, a radio frequency (RF) link, or any other medium which can be used to store the desired information and which can be accessed. The computer data signal may include any signal that can propagate over a transmission medium such as electronic network channels, optical fibers, air, electromagnetic, RF links, etc. The code segments may be downloaded via computer networks such as the Internet, Intranet, etc. In any case, the present invention should not be construed as limited by such embodiments.

A speech separation system 200 may include various combinations of one or more speech enhancement modules 210, speech de-noising modules 220, and speech feature extraction modules 230. The speech separation system 200 may also include one or more speech recognition modules (not shown) to be described below. Each of the modules can be used by itself as a stand-alone system or as part of a larger system. As described below, the speech separation system is preferably incorporated into an electronic device that accepts speech input in order to control certain functions, or otherwise requires separation of desired noises from background noises. Many applications require enhancing or separating clear desired sound from background sounds originating from multiple directions. Such applications include human-machine interfaces such as in electronic or computational devices which incorporate capabilities such as voice recognition and detection, speech enhancement and separation, voice-activated control, and the like. Due to the lower processing power required by the invention speech separation system, it is suitable in devices that only provide limited processing capabilities.

Improved ICA Processing

Figure 3:
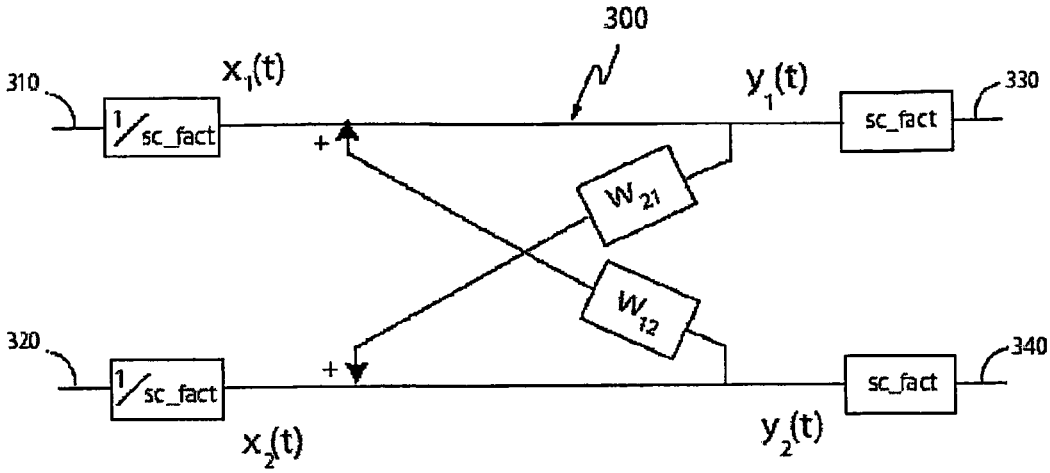

FIG. 3 illustrates one embodiment 300 of an improved ICA or BSS processing sub-module 212. Input signals $X_1$ and $X_2$ are received from channels 310 and 320, respectively. Typically, each of these signals would come from at least one microphone, but it will be appreciated other sources may be used. Cross filters $W_1$ and $W_2$ are applied to each of the input signals to produce a channel 330 of separated signals $U_1$ and a channel 340 of separated signals $U_2$. Channel 330 (speech channel) contains predominantly desired signals and channel 340 (noise channel) contains predominantly noise signals. It should be understood that although the terms "speech channel" and "noise channel" are used, the terms "speech" and "noise" are interchangeable based on desirability, e.g., it may be that one speech and/or noise is desirable over other speeches and/or noises. In addition, the method can also be used to separate the mixed noise signals from more than two sources.

Infinitive impulse response filters are preferably used in the improved ICA processing process. An infinitive impulse response filter is a filter whose output signal is fed back into the filter as at least a part of an input signal. A finite impulse response filter is a filter whose output signal is not feedback as input. The cross filters $W_{21}$ and $W_{12}$ can have sparsely distributed coefficients over time to capture a long period of time delays. In a most simplified form, the cross filters $W_{21}$ and $W_{12}$ are gain factors with only one filter coefficient per filter, for example a delay gain factor for the time delay between the output signal and the feedback input signal and an amplitude gain factor for amplifying the input signal. In other forms, the cross filters can each have dozens, hundreds or thousands of filter coefficients. As described below, the output signals $U_1$ and $U_2$ can be further processed by a post processing sub-module, a de-noising module or a speech feature extraction module.

Although the ICA learning rule has been explicitly derived to achieve blind source separation, its practical implementation to speech processing in an acoustic environment may lead to unstable behavior of the filtering scheme. To ensure stability of this system, the adaptation dynamics of $W_{12}$ and similarly $W_{21}$ have to be stable in the first place. The gain margin for such a system is low in general meaning that an increase in input gain, such as encountered with non stationary speech signals, can lead to instability and therefore exponential increase of weight coefficients. Since speech signals generally exhibit a sparse distribution with zero mean, the sign function will oscillate frequently in time and contribute to the unstable behavior. Finally since a large learning parameter is desired for fast convergence, there is an inherent trade-off between stability and performance since a large input gain will make the system more unstable. The known learning rule not only lead to instability, but also tend to oscillate due to the nonlinear sign function, especially when approaching the stability limit, leading to reverberation of the filtered output signals $Y_1[t]$ and $Y_2[t]$. To address these issues, the adaptation rules for $W_{12}$ and $W_{21}$ need to be stabilized. If the learning rules for the filter coefficients are stable, extensive analytical and empirical studies have shown that systems are stable in the BIBO (bounded input bounded output). The final corresponding objective of the overall processing scheme will thus be blind source separation of noisy speech signals under stability constraints.

The principal way to ensure stability is therefore to scale the input appropriately as illustrated by FIG. 3. In this framework the scaling factor sc_fact is adapted based on the incoming input signal characteristics. For example, if the input is too high, this will lead to an increase in sc_fact, thus reducing the input amplitude. There is a compromise between performance and stability. Scaling the input down by sc_fact reduces the SNR which leads to diminished separation performance. The input should thus only be scaled to a degree necessary to ensure stability. Additional stabilizing can be achieved for the cross filters by running a filter architecture that accounts for short term fluctuation in weight coefficients at every sample, thereby avoiding associated reverberation. This adaptation rule filter can be viewed as time domain smoothing. Further filter smoothing can be performed in the frequency domain to enforce coherence of the converged separating filter over neighboring frequency bins. This can be conveniently done by zero tapping the K-tap filter to length L, then Fourier transforming this filter with increased time support followed by Inverse Transforming. Since the filter has effectively been windowed with a rectangular time domain window, it is correspondingly smoothed by a sinc function in the frequency domain. This frequency domain smoothing can be accomplished at regular time intervals to periodically reinitialize the adapted filter coefficients to a coherent solution.

The following equations are examples of nonlinear bounded functions that can be used for each time sample window of size t and with k being a time variable, $$U_1(t)=X_1(t)+W_{12}(t)X_2(t) \quad \text{(Eq. 1)}$$

$$U_2(t)=X_2(t)+W_{21}(t)X_1(t) \quad \text{(Eq. 2)}$$

$$Y1=\text{sign}\ (U1) \quad \text{(Eq. 3)}$$

$$Y2=\text{sign}\ (U2) \quad \text{(Eq. 4)}$$

$$\Delta W_{12k} = -f(Y_1) \times U_2[t-k] \quad \text{(Eq. 5)}$$

$$\Delta W_{21k} = -f(Y_2) \times U_1[t-k] \quad \text{(Eq. 6)}$$

The function f(x) is a nonlinear bounded function, namely a nonlinear function with a predetermined maximum value and a predetermined minimum value. Preferably, f(x) is a nonlinear bounded function which quickly approaches the maximum value or the minimum value depending on the sign of the variable x. For example, Eq. 3 and Eq. 4 above use a sign function as a simple bounded function. A sign function f(x) is a function with binary values of 1 or −1 depending on whether x is positive or negative. Example nonlinear bounded functions include, but are not limited to:

$$f(x) = \text{sign}(x) = \left\{ \begin{array}{c|c} 1 & x > 0 \\ -1 & x \le 0 \end{array} \right\} \quad \text{(Eq. 7)}$$

$$f(x) = \tanh(x) = \frac{e^x - e^{-x}}{e^x + e^{-x}} \quad \text{(Eq. 8)}$$

$$f(x) = \text{simple}(x) = \left\{ \begin{array}{c|c} 1 & x \ge \varepsilon \\ x/\varepsilon & -\varepsilon > x > \varepsilon \\ -1 & x \le -\varepsilon \end{array} \right\} \quad \text{(Eq. 9)}$$

These rules assume that floating point precision is available to perform the necessary computations. Although floating point precision is preferred, fixed point arithmetic may be employed as well, more particularly as it applies to devices with minimized computational processing capabilities. Notwithstanding the capability to employ fixed point arithmetic, convergence to the optimal ICA solution is more difficult. Indeed the ICA algorithm is based on the principle that the interfering source has to be cancelled out. Because of certain inaccuracies of fixed point arithmetic in situations when almost equal numbers are subtracted (or very different numbers are added), the ICA algorithm may show less than optimal convergence properties.

Another factor which may affect separation performance is the filter coefficient quantization error effect. Because of the limited filter coefficient resolution, adaptation of filter coefficients will yield gradual additional separation improvements at a certain point and thus a consideration in determining convergence properties. The quantization error effect depends on a number of factors but is mainly a function of the filter length and the bit resolution used. The input scaling issues listed previously are also necessary in finite precision computations where they prevent numerical overflow. Because the convolutions involved in the filtering process could potentially add up to numbers larger than the available resolution range, the scaling factor has to ensure the filter input is sufficiently small to prevent this from happening.

Multi-Channel Improved ICA Processing

The improved ICA processing sub-module 212 receives input signals from at least two audio input channels, such as microphones. The number of audio input channels can be increased beyond the minimum of two channels. As the number of input channels increases, speech separation quality may improve, generally to the point where the number of input channels equals the number of audio signal sources. For example, if the sources of the input audio signals include a speaker, a background speaker, a background music source, and a general background noise produced by distant road noise and wind noise, then a four-channel speech separation system will normally outperform a two-channel system. Of course, as more input channels are used, more filters and more computing power are required.

The improved ICA processing sub-module and process can be used to separate more than two channels of input signals. For example, in a cellular phone application, one channel may contain substantially desired speech signal, another channel may contain substantially noise signals from one noise source, and another channel may contain substantially audio signals from another noise source. For example, in a multi-user environment, one channel may include speech predominantly from one target user, while another channel may include speech predominantly from a different target user. A third channel may include noise, and be useful for further process the two speech channels. It will be appreciated that additional speech or target channels may be useful.

Although some applications involve only one source of desired speech signals, in other applications there may be multiple sources of desired speech signals. For example, teleconference applications or audio surveillance applications may require separating the speech signals of multiple speakers from background noise and from each other. The improved ICA process can be used to not only separate one source of speech signals from background noise, but also to separate one speaker's speech signals from another speaker's speech signals.

Peripheral Processing

To increase performance of the invention methods and systems in efficacy and robustness, varying peripheral processing techniques can be applied to the input and output signals and in varying degrees. Pre-processing techniques as well as post-processing techniques which complement the methods and systems described herein clearly will enhance the performance of blind source separation techniques applied to audio mixtures. For example, post-processing techniques can be used to improve the quality of the desired signal utilizing the undesirable output or the unseparated inputs. Similarly, pre-processing techniques or information can enhance the performance of blind source separation techniques applied to audio mixtures by improving the conditioning of the mixing scenario to complement the methods and systems described herein.

Figure 4:
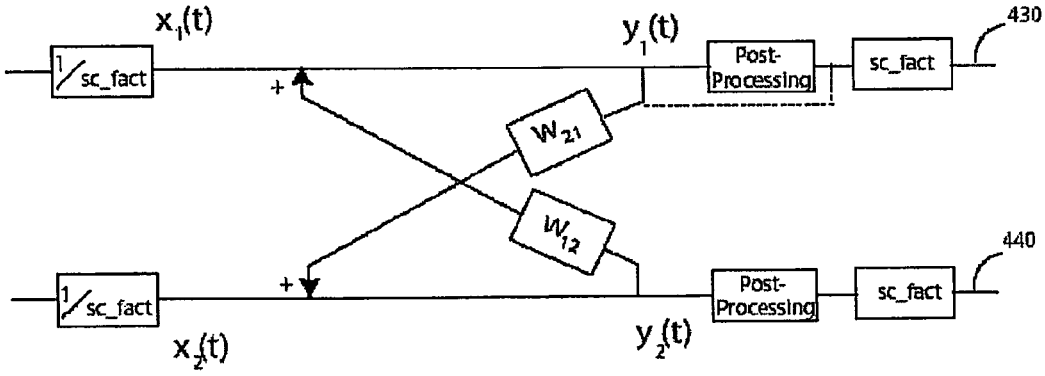
FIG. 4 a block diagram of one embodiment of an improved ICA speech separation process in accordance with the present invention.

Improved ICA processing separates sound signals into at least two channels, for example one channel for noise signals (noise channel) and one channel for desired speech signals (speech channel). As shown in FIG. 4, channel 430 is the speech channel and channel 440 is the noise channel. It is quite possible that the speech channel contains an undesirable level noise signals and the noise channel still contains some speech signals. For example, if there are more than two significant sound sources and only two microphones, or if the two microphones are located close together but the sound sources are located far apart, then improved ICA processing alone might not always adequately separate desired speech from noise. The processed signals therefore may need to be post-processed to remove remaining levels of background noise and/or to further improve the quality of the speech signals. This is achieved by feeding the separated ICA outputs through a single or multi channel speech enhancement algorithm, for example. A Wiener filter with the noise spectrum estimated from non-speech time intervals detected with a voice activity detector is used to achieve better SNR for signals degraded by background noise with long time support. In addition, the bounded functions are only simplified approximations to the joint entropy calculations, and might not always reduce the signals' information redundancy completely. Therefore, after signals are separated using improved ICA processing, post processing may be performed to further improve the quality of the speech signals.

The separated noise signal channel could be discarded but may also be used for other purposes. Based on the reasonable assumption that the remaining noise signals in the speech channel have similar signal signatures as the noise signals in the noise channel, those signals in the desired speech channel whose signatures are similar to the signatures of the noise channel signals should be filtered out in the post-processing unit. For example, spectral subtraction techniques can be used to perform post processing. The signatures of the signals in the noise channel are identified. Compared to prior art noise filters that relay on predetermined assumptions of noise characteristics, the post processing is more flexible because it analyzes the noise signature of the particular environment and removes noise signals that represent the particular environment. It is therefore less likely to be over-inclusive or under-inclusive in noise removal. Other filtering techniques such as Wiener filtering and Kalman filtering can also be used to perform post processing. Since the ICA filter solution will only converge to a limit cycle of the true solution, the filter coefficients will keep on adapting without resulting in better separation performance. Some coefficients have been observed to drift to their resolution limits. Therefore a post-processed version of the ICA output containing the desired speaker signal is fed back through the IIR feedback structure as illustrated by FIG. 4 so the convergence limit cycle is overcome and not destabilizing the ICA algorithm. A beneficial byproduct of this procedure is that convergence is accelerated considerably.

Other processes such as de-noising, speech feature extraction can be used together with speech enhancement to further improve the quality of the speech signals. Speech recognition applications can take advantage of speech signals separated by the speech enhancement process. With speech signals substantially separated from noise, speech recognition engines based on methods such as Hidden Markov Model chains, neural network learning and support vector machines can work with greater accuracy.

Figure 5:
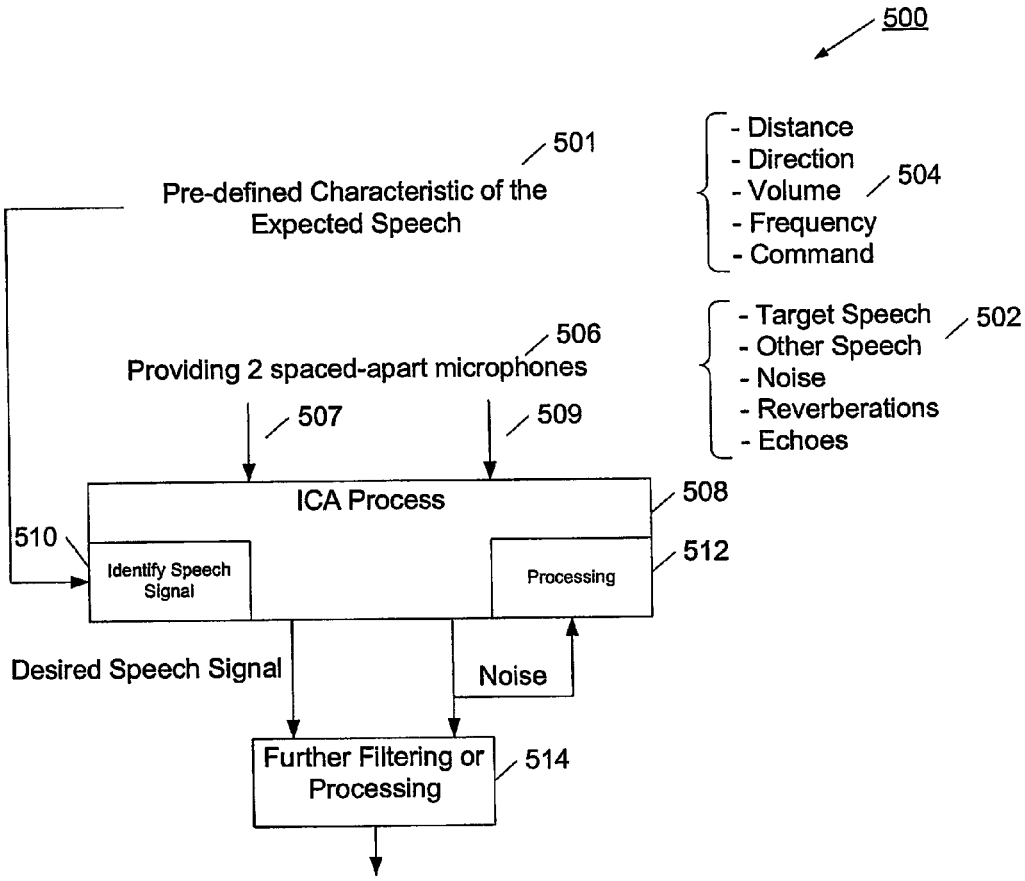
FIG. 5 is a flowchart of a speech processing method in accordance with the present invention.

Referring now to FIG. 5, a flowchart of a speech process is shown. Method 500 may be used in a speech device, such as a portable wireless mobile phone, a telephone headset, or in a hands-free car kit, for example. It will be appreciated that method 500 may be used on other speech devices, and may be implemented on DSP processors, general computing processors, microprocessors, gate arrays, or other computational devices. In use, method 500 receives acoustic signals in the form of sound signals 502. These sound signals 502 may come from many sources, and may include the speech from a target user, speech from others in the vicinity, noise, reverberations, echoes, reflections, and other undesirable sounds. Although method 500 is shown identifying and separating a single target speech signal, it will be understood that method 500 may be modified to identify and separate additional target sound signals.

In addition, varying preprocessing techniques or information can be used to improve or facilitate the processing and separation of the mixed audio signals, such as utilizing a priori knowledge, maximizing divergent information or characteristics in the input signals and conditions, improving the conditioning of the mixing scenario, and the like. For example, since the output order of the separated ICA sound channels is in general unknown beforehand, an additional channel selection stage 510 processes the content of the separated channels based on a priori knowledge 501 about the desired speaker in an iterative manner. The criteria 504 used to identify desired speaker speech characteristics can be based on, but are not limited to, spatial or temporal features, energy, volume, frequency content, zero crossing rate or speaker dependent and independent speech recognition scores computed in parallel to the separation process. For example, the criteria 504 could be configured to respond to constrained vocabulary such as a particular command, e.g., "wake up". In another example, the speech device could respond to a sound signal emanating from a particular location or direction, such as the front driver's position in a car. In this way a hands-free car kit could be configured to respond only to speech from the driver, while ignoring speech from passengers and the radio. Alternatively, the conditions of the mixing scenario can be improved by modulating or manipulating the characteristics of the input signals, for example by spatial, temporal, energy, spectral, and the like, modulations and manipulations.

On some speech devices, the microphones are consistently placed based on predefined distance from the speech source, the background noises or in relation to the other microphones, or have certain characteristics themselves to condition the input signals, e.g., directional microphones. As shown in block 506, two microphones may be spaced apart and placed on the housing of a speech device. For example, a telephone headset is typically adjusted so that the microphones are within about one inch of the speaker's mouth, and the speaker's voice is typically the closest sound source to the microphone. In a similar manner, the microphones for a handheld wireless phone, handset, or lapel microphone typically have a reasonably known distance to the target speaker's mouth. Since the distance from the microphones to the target source is known, this distance may be used a characteristic to identify the target speech signal. Also, it will be appreciated that multiple characteristics may be used. For example, the process 510 may select only a sound signal that comes from less than two inches away and that has a frequency component indicative of a male voice. In those cases where a two microphone setup is used, the microphones are arranged close to the desired speaker's mouth. This setup allows to isolate the desired speaker's voice signal into one separated ICA channel so that the remaining separated output channel containing only noise can be used as a noise reference for subsequent post processing of the desired speaker channel.

In recording scenarios where more than two microphones are used, the two channel ICA algorithm is extended to a N-channel (microphone) algorithm in a similar fashion as explained earlier for the two channel scenario, with N*(N−1) ICA cross filters. The latter one is used for source localization purposes along with the channel selection procedure presented in [ad2] to select among the N recorded channels the optimal two channel combination which is then processed in a two channel ICA algorithm to separate the desired speaker. All kind of information sources resulting from the N-channel ICA separation like, but not limited to, relative energy changes from recorded input to separated output sources as well as learned ICA cross filter coefficients are exploited to this end.

Each of the spaced apart microphones receives a signal that is a mixture of the desired target sound and of several noise and reverberation sources. The mixed sound signals 507 and 509 are receive in the ISA process 508 for separation. After identifying the target speech signal using the identification process 510, the ICA process 508 separates the mixed sounds into a desired speech signal and a noise signal. The ICA process may use the noise signal to further process 512 the speech signal, for example, by using the noise signal to further refine and set weighting factors. Also, the noise signal may also be used by additional filtering 514 or processes to further remove noise content from the speech signal, as further described below.

De-Noising

Figure 6:
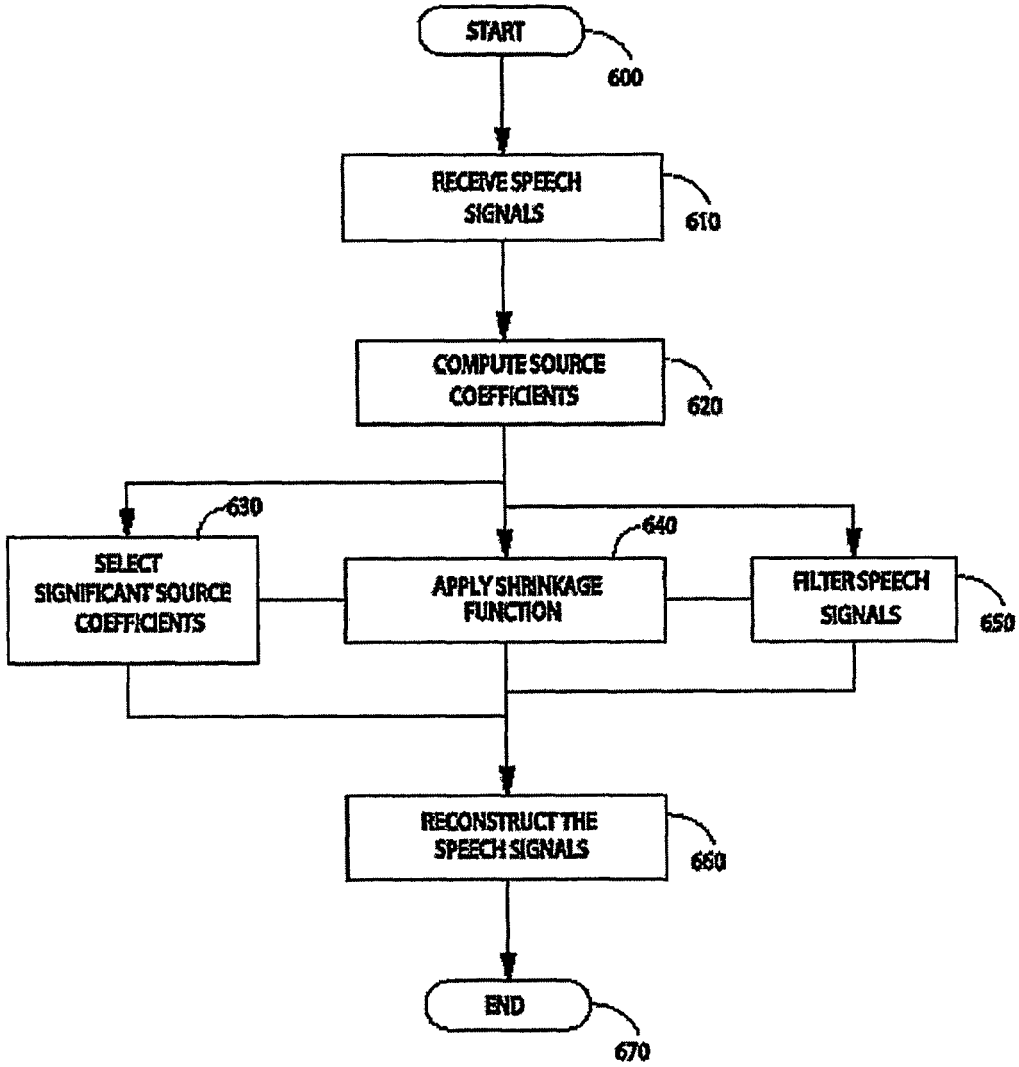
FIG. 6 is a flowchart of a speech de-noising process in accordance with the present invention.

FIG. 6 is a flowchart showing one embodiment of a de-noising process. In cell phone applications, de-noising is best used to separate out noise sources that are not spatially localized, such as wind noise that comes from all directions. De-noising techniques can also be used to remove noise signals with fixed frequencies. From a start block 600, the process proceeds to a block 610. At the block 610, the process receives a block of speech signals x. The process proceeds to a block 620, where the system computes source coefficients s, preferably using the following formula $$s_i = \sum_j w_{ij} * x_j \quad \text{(Eq. 10)}$$

In the formula above, $w_{ij}$ represents an ICA weight matrix. An ICA method described in U.S. Pat. No. 5,706,402 or an ICA method described in U.S. Pat. No. 6,424,960 can be used in the de-noising process. The process then proceeds to a block 630, a block 640, or a block 650. The blocks 630, 640 and 650 represent alternative embodiments. At the block 630, the process selects a number of significant source coefficients based on the power of the signal $s_i$. At the block 640, the process applies a maximum likelihood shrinkage function to the computed source coefficients to eliminate the insignificant coefficients. At the block 650, the process filters the speech signals x with one of the basis functions for each time sample t.

From the block 630, 640, or 650, the process proceeds to a block 660, where the process reconstructs the speech signals, preferably using the following formula $$x_{new} = \sum_j a_{ij} * s_{j,shrinked} \quad \text{(Eq. 11)}$$

In the above formula, $a_{ij}$ represents the training signals produced by filtering incoming signals with the weight factors. The de-noising process thus removes noise and produces the reconstructed speech signals $x_{new}$. Good de-noising results are obtained when information about the noise sources is available. As described above in connection with the improved ICA process, the signatures of signals in the noise channel can be used by the de-noising process to remove noise from signals in the speech channel. From the block 660, the process proceeds to an end block 670.

Speech Feature Extraction

Figure 7:
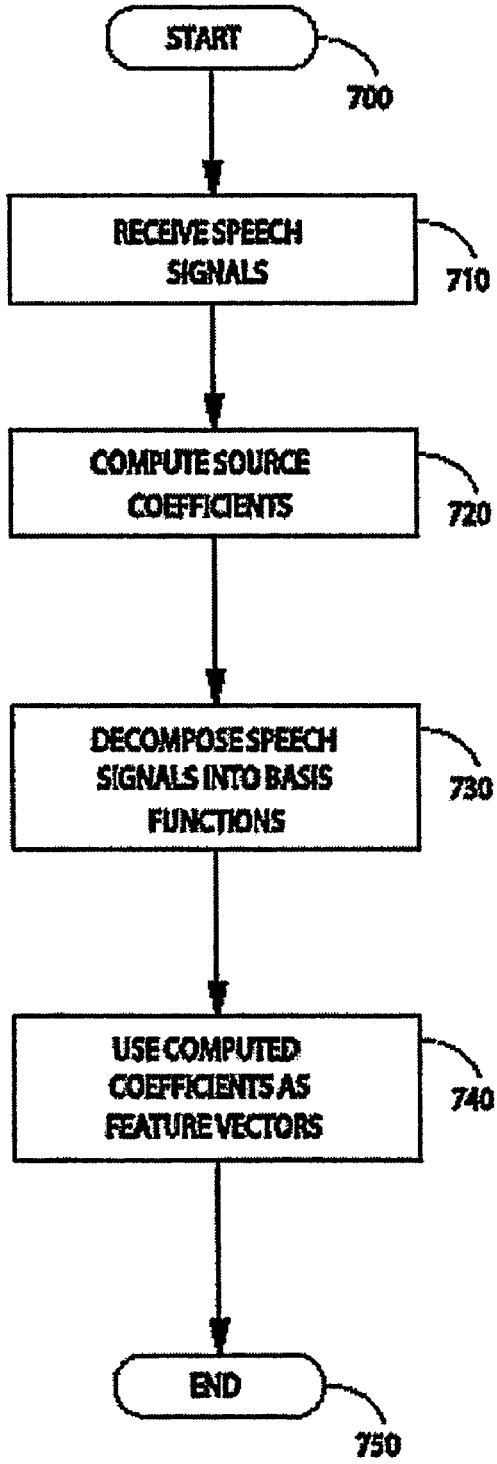
FIG. 7 is a flowchart of a speech feature extraction process in accordance with the present invention

FIG. 7 illustrates one embodiment of a speech feature extraction process using ICA. The process starts from a start block 700 to a block 710, where the process receives speech signals x. As described below in connection with FIG. 9, the speech signals x can be the input speech signals, signals processed by speech enhancement, signals processed by de-noising, or signals processed by speech enhancement and de-noising.

Referring back to FIG. 7, the process proceeds from the block 710 to a block 720, where the process computes source coefficients using the formula $s_{ij,\ new}=W*x_{ij}$ as described above by Eq. 10. The process then proceeds to a block 730, where the received speech signals are decomposed into basis functions. From the block 730, the process proceeds to a block 740, where the computed source coefficients are used as feature vectors. For example, the computed coefficients $s_{ij,\ new}$ or $2\log s_{ij,\ new}$ are used in calculating feature vectors. The process then proceeds to an end block 750.

The extracted speech features can be used to recognize speech or to distinguish recognizable speech from other audio signals. The extracted speech features can be used by themselves or in conjunction with cepstral features (MFCC). The extracted speech features can also be used to identify speakers, for example to identify individual speakers from speech signals of multiple speakers, or to identify speech signals as belonging to certain classes such as speech from male or female speakers. The extracted speech features can also be used by a classification algorithm to detect speech signals. For example, a maximum likelihood calculation can be used to determine the likelihood that the signals in question are human speech signals.

The extracted speech features can also be applied in text-to-speech applications that produce computer readings of texts. Text-to-speech systems use a large database of speech signals. One challenge is to obtain a good representative database of phonemes. Prior art systems use cepstral features to classify the speech data into the phoneme database. By decomposing speech signals into basis functions, the improved speech feature extraction method can better classify speech into phoneme segments and therefore produce a better database, thus allowing better speech quality for text-to-speech systems.

In one embodiment of a speech feature extraction process, one set of basis functions is used for all speech signals to recognize speech. In another embodiment, one set of basis functions is used for each speaker to recognize each speaker. This may be particularly advantageous for multiple-speaker applications such as teleconferences. In yet another embodiment, one set of basis functions is used for one class of speakers to recognize each class. For example, one set of basis functions is used for male speakers and another set is used for female speakers. U.S. Pat. No. 6,424,960 describes using an ICA mixture model to identify voices of different classes. Such a model can be used to identify speech signals of different speakers or different genders of speakers.

Speech Recognition

Speech recognition applications can take advantage of speech signals separated by improved ICA processing. With speech signals substantially separated from noise, speech recognition applications can work with greater accuracy. Methods such as Hidden Markov Model, neural network learning and support vector machines can be used in speech recognition applications. As described above, in a two-microphone arrangement, improved ICA processing separates input signals into a speech channel of desired speech signals and some noise signals, and a noise channel of noise signals and some speech signals.

To improve speech recognition accuracy in noisy environments, it is preferable to have an accurate noise reference signal to remove noise from speech signals based on the noise reference signal. For example, using speech spectral subtraction to remove, from a channel of substantially speech signals, signals that have the characteristics of the noise reference signal. Therefore, in a preferred speech recognition system for very noisy environments, the system receives a speech channel and a noise channel of signals and identifies a noise reference signal.

Process Combinations

Figures 8, 9:
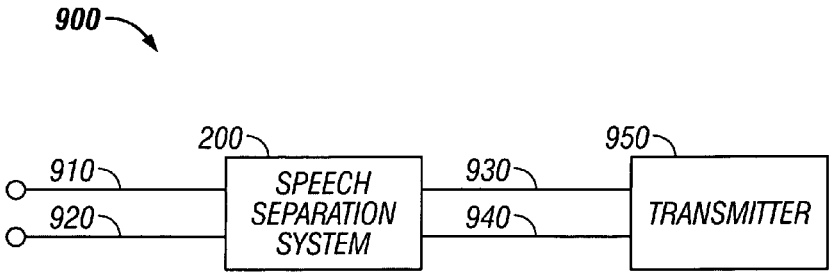
FIG. 8 is a table showing examples of combinations of speech processing processes in accordance with the present invention.
FIG. 9 is a block diagram one embodiment of a cellular phone with a speech separation system in accordance with the present invention.

Certain embodiments of speech feature extraction, de-noising and speech recognition processes have been described along with the speech enhancement processes. It is worth noting that not all processes need to be used together. FIG. 8 is a table 800 listing some of the typical combinations of speech enhancement, de-noising and speed feature extraction processes. The left column of the table 800 lists the type of the signals and the right column lists the preferred processes for processing the corresponding type of signals.

In one arrangement shown in row 810, input signals are first processed using speech enhancement, then processed using speech de-noising, and then processed using speech feature extraction. The combination of these three processes works well when input signals contain heavy noise and competing source. Heavy noise refers to relatively low amplitude noise signals that come from multiple sources, for example on a street where various types of noises come from different directions but not one type of noise is particularly loud. Competing source refers to high amplitude signals from one or few sources that compete with the desired speech signals, for example a car radio turned to a high volume when the driver is speaking on a car phone. In another arrangement shown in row 820, input signals are first processed using speech enhancement and then processed using speech feature extraction. The speech de-noising process is omitted. The combination of speech enhancement and speech feature extraction processes works well when original signals contain competing source and do not contain heavy noise.

In yet another arrangement shown in row 830, input signals are first processed using speech de-noising and then processed using speech feature extraction. The speech enhancement process is omitted. The combination of speech de-noising and speech feature extraction processes works well when input signals contain heavy noise and do not contain competing source. In still another arrangement shown in row 840, only speech feature extraction is performed on the input signals. This process is sufficient to reach good results for relatively clean speech that does not contain heavy noise or competing source. Of course, table 800 is only a list of examples and other embodiments can be used. For example, all of the speech enhancement, speech de-noising and speech feature extraction processes can be applied to process signals regardless of their types.

Cellular Phone Applications

FIG. 9 illustrates one embodiment of a cellular phone device. The cell phone device 900 includes two microphones 910 and 920 for recording sound signals, and a speech separation system 200 for processing the recorded signals to separate the desired speech signal from background noise. The speech separation system 200 includes at least an improved ICA processing sub-module that applies cross filters to the recorded signals to produce separated signals on channels 930 and 940. The separated desired speech signals are then transmitted by transmitter 950 to an audio signal receiving device such as a wired phone or another cellular phone.

The separated noise signals may be discarded but may also be used for other purposes. The separated noise signals may be used to determine environment characteristics and adjust cell phone parameters accordingly. For example, the noise signals may be used to determine the noise level of the speaker's environment. The cell phone then increases the volume of the microphones if the speaker is in environment with high noise level. As described above, the noise signals can also be used as reference signals to further remove remaining noise from the separated speech signals.

For ease of illustration, other cell phone parts such as the battery, the display panel and so forth are omitted from FIG. 9. Cell phone signal processing steps involving analog-to-digital conversion, modulating or to enable FDMA (frequency division multiple access), TDMA (time division multiple access) or CDMA (channel division multiple access) and so forth are also omitted for ease of illustration.

Although FIG. 9 shows two microphones, more than two microphones can be used. Existing manufacturing technology can produce microphones that are about the size of a dime, a pin head or smaller, and multiple microphones can be placed on a device 900.

In one embodiment, the conventional echo-cancellation process performed in a cell phone is replaced by an ICA process such as the process performed by the improved ICA sub-module.

Since the audio signal sources are typically apart from each other, the microphones are preferably placed acoustically apart on a cell phone. For example, one microphone can be placed on the front side of the cell phone while another microphone can be placed on the back side of the cell phone. One microphone can be placed near the top or left side of the cell phone while another microphone can be placed near the bottom or right side of the cell phone. Two microphones can be placed on different locations of the cell phone headset. In one embodiment, two microphones are placed on the headset and two more microphones are placed on the cell phone handheld unit. Therefore two microphones can record the user's speech regardless whether the user uses the handheld unit or the headset.

Although a cellular phone with improved ICA processing is described as an example, other speech communication mediums, such as voice command for electronic appliances, wired telephones, speakerphones, cordless telephones, teleconferences, CB radios, walkie-talkies, computer telephony applications, computer and automobile speech recognition applications, surveillance devices, intercoms and so forth and also take advantage of improved ICA processing to separate desired speech signals from other signals.

Figure 10:
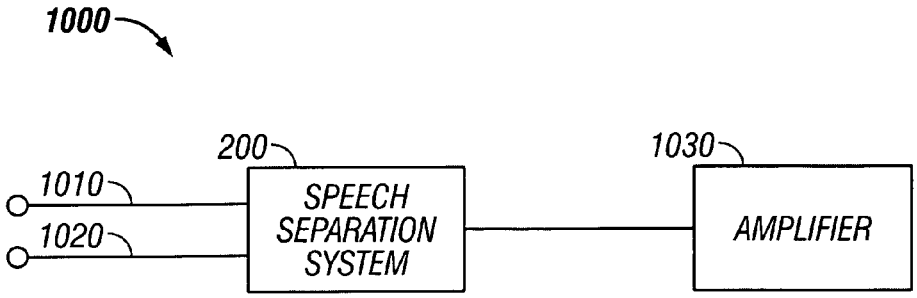
FIG. 10 is a block diagram of another embodiment of a cellular phone with a speech separation system.

FIG. 10 illustrates another embodiment of a cellular phone device. The cell phone device 1000 includes two channels 1010 and 1020 for receiving sound signals from another communication device such as another cellular phone. The channels 1010 and 1020 receive sound signals of the same conversation recorded by two microphones. More than two receiving units can be used to receive more than two channels of input signals. The device 1000 also includes a speech separation system 200 for processing the received signals to separate the desired speech signal from background noise. The separated desired speech signals are then amplified by an amplifier 1030 to reach the ear of the cell phone user. By placing the speech separation system 200 on the receiving cell phone, the user of the receiving cell phone can hear high-quality speech even if the transmitting cell phone does not have a speech separation system 200. However, this requires receiving two channels of signals of a conversation recorded by two microphones on the transmitting cell phone.

For ease of illustration, other cell phone parts such as the battery, the display panel and so forth are omitted from FIG. 10. Cell phone signal processing steps involving digital-to-analog conversion, demodulating or to enable FDMA (frequency division multiple access), TDMA (time division multiple access) or CDMA (channel division multiple access) and so forth are also omitted for ease of illustration.

Certain aspects, advantages and novel features of the invention have been described herein. Of course, it is to be understood that not necessarily all such aspects, advantages or features will be embodied in any particular embodiment of the invention. The embodiments discussed herein are provided as examples of the invention, and are subject to additions, alterations and adjustments. For example, although equations 7, 8, and 9 present examples of a nonlinear bounded function, nonlinear bounded functions are not limited to these examples but can include any nonlinear function with pre-determined maximum and minimum values. Therefore, the scope of the invention should be defined by the following claims.

REFERENCES

Hyvaerinen, A., Karhunen, J, Oja, E. Independent component analysis. John Wiley & Sons, Inc. 2001

Te-Won Lee, Independent Component Analysis: Theory and Applications, Kluwer Academic Publishers, Boston, September 1998

Mark Girolami, Self-Organizing Neural Networks: Independent Component Analysis and Blind Source Separation. In Perspectives in Neural Computing, Springer Verlag, September 1999

Mark Girolami (Editor), Advances in Independent Component Analysis. In Perspectives in Neural Computing, Springer Verlag, August 2000

Simon Haykin, Adaptive Filter Theory, Third Edition, Prentice-Hall (NJ), 1996.

Bell, A., Sejnowski, T., Neural Computation 7:1129-1159, 1995

Amari, S., Cichocki, A., Yang, H., A New Learning Algorithm for Blind Signal Separation, In: Advances in Neural Information Processing Systems 8, Editors D. Touretzky, M. Mozer, and M. Hasselmo, pp. 757-763, MIT Press, Cambridge Mass., 1996.

Cardoso, J.-F., Iterative techniques for blind source separation using only fourth order cumulants In Proc. EUSIPCO, pages 739-742, 1992.

Comon, P., Independent component analysis, a new concept? Signal Processing, 36(3):287-314, April 1994.

Hyvaerinen, A. and Oja, E, A fast fixed-point algorithm for independent component analysis. Neural Computation, 9, pp. 1483-1492, 1997

What is claimed is:

1. A method of separating a desired speech signal in an acoustic environment, comprising:

receiving a plurality of input signals, the input signals being generated responsive to the desired speech signal and other acoustic signals;

processing the received input signals using an independent component analysis (ICA) or blind source separation (BSS) method under stability constraints, wherein the ICA or BSS method modulates the mathematical formulation of mutual information directly or indirectly through approximations; and separating the received input signals into output channels comprising one or more desired audio output signals and one or more noise output signals.

2. The method according to claim 1, wherein one of the desired audio signals is the desired speech signal.

3. The method according to claim 2, further comprising utilizing characteristic information of the desired speech signal to identify the output channel comprising the separated desired speech signal.

4. The method according to claim 3 wherein the characteristic information is spatial, spectral or temporal information.

5. The method according to claim 1, wherein the ICA method further comprises minimizing or maximizing the mathematical formulation of mutual information directly or indirectly through approximations.

6. The method according to claim 1, wherein the stability constraints comprise pacing the adapting of an ICA filter.

7. The method according to claim 1, wherein the stability constraints comprise scaling the received input signals using an adaptive scaling factor, the adaptive scaling factor being selected to constrain weight adaptation speed.

8. The method according to claim 1, wherein the stability constraints comprise filtering learned filter weights in the time domain and the frequency domain, the filtering selected to avoid introduction of artificial reverberation effects.

9. The method according to claim 1, further comprising applying peripheral pre-processing or post-processing techniques to at least one of the received input signals or at least one of the separated output signals.

10. The method according to claim 1, further comprising pre-processing the received input signals.

11. The method according to claim 10, further comprising improving the conditioning of a mixing scenario applied to the input signals.

12. The method according to claim 1, further comprising applying post-processing techniques to at least one of the output signals using at least one processing signal selected from one or more of the noise signals and one or more of the input signals.

13. The method according to claim 12, wherein the using at least one processing signal consists of using the noise signal.

14. The method according to claim 13 wherein the using the noise signal comprises using the noise signal to estimate the noise spectrum for a noise filter.

15. The method according to claim 1, further comprising:

spacing apart at least a first and a second microphone; and generating one of the input signals at each respective microphone.

16. The method according to claim 15, wherein the spacing apart at least a first and a second microphone comprises spacing the microphones between about 1 millimeter and about 1 meter apart.

17. The method according to claim 15, wherein the spacing apart at least a first and a second microphone comprises spacing the microphones apart on a telephone receiver, a headset, or a hands-free kit.

18. The method according to claim 1, wherein the ICA or BSS method comprises:

adapting a first adaptive ICA filter connected to a first output signal and to a second input signal by a recursive learning rule involving the application of a nonlinear bounded sign function to one or more noise output signals; and adapting a second adaptive ICA filter connected to a first input signal and to a second output signal by a recursive learning rule involving the application of a nonlinear bounded sign function to the one or more desired audio output signals, wherein the first filter and the second filter are repeatedly applied to produce the desired speech signal.

19. The method according to claim 18, further comprising:

spacing apart at least a first and a second microphone;

generating one of the input signals at each respective microphone;

recursively filtering the one or more desired audio output signals by the first adaptive independent component analysis filter to obtain a recursively filtered speech signal;

recursively filtering the one or more noise output signals by the second adaptive independent component analysis filter to obtain a recursively filtered noise signal;

adding the recursively filtered speech signal to the input signal from the second microphone, thereby producing the one or more noise output signals; and adding the recursively filtered noise signal to the input signal from the first microphone, thereby producing the one or more desired audio output signals.

20. The method according to claim 19, wherein the received input signals are inversely scaled by an adaptive scaling factor computed from a recursive equation as a function of incoming signal energy.

21. The method according to claim 18, further comprising:

stabilizing a recursive learning rule adapting the first adaptive ICA filter by smoothing coefficients of the first adaptive ICA filter in time; and stabilizing a recursive learning rule adapting the second adaptive ICA filter by smoothing coefficients of the second adaptive ICA filter in time.

22. The method according to claim 18, wherein filter weights of the first adaptive ICA filter are filtered in the frequency domain, and wherein filter weights of the second adaptive ICA filter are filtered in the frequency domain.

23. The method according to claim 18, wherein the ICA method is implemented in a fixed point computing precision environment and wherein the ICA method further comprises:

applying the adaptive ICA filters at every sampling instant;

updating filter coefficients at multiples of the sampling instant; and adapting filter lengths of variable sizes according to the computational power available.

24. The method according to claim 1, further comprising post processing the desired speech signal comprising voice activity detection and wherein post-processed outputs are not fed back to input signals.

25. The method according to claim 1, further comprising applying spectral subtracting to the one or more desired audio output signals based on the one or more noise signals.

26. The method according to claim 1, further comprising applying Wiener filtering to the one or more desired audio output signals based on the one or more noise signals.

27. The method according to claim 1, further generating a third set of audio input signals at a third microphone, and applying a nonlinear bounded function to incoming signals using a third filter.

28. A system for separating a desired speech signal in an acoustic environment, comprising a plurality of input channels each receiving one or more acoustic signals, wherein the one or more acoustic signals comprises a speech signal;

at least one independent component analysis (ICA) or blind-source separation (BSS) filter module comprising an ICA or BSS filter that separates the received signals into one or more desired audio signals and one or more noise signals;

a stability constraint, wherein the stability constraint at least partially stabilizes the ICA or BSS filter; and a plurality of output channels transmitting the separated signals, wherein the filter modulates the mathematical formulation of mutual information directly or indirectly through approximations.

29. The system according to claim 28, wherein the one or more acoustic signals comprise the one or more desired audio signals.

30. The system according to claim 28, wherein implementing the stability constraint paces adaptation of the ICA or BSS filter.

31. The system according to claim 28, wherein implementing the stability constraint comprises scaling ICA or BSS inputs using an adaptive scaling factor, the adaptive scaling factor selected to constrain adaptation speed.

32. The system according to claim 28, wherein implementing the stability constraint comprises filtering learned filter weights in the time domain and the frequency domain, the filter selected to avoid introduction of artificial reverberation effects.

33. The system according to claim 28, further comprising one or more processing modules comprising at least one filter selected from a pre-processing peripheral filter and a post-processing peripheral filter applied to the one or more acoustic signals and/or the separated signals.

34. The system according to claim 33, wherein the filter is the pre-processing peripheral filter.

35. The system according to claim 33, wherein the filter is the post-processing peripheral filter.

36. The system according to claim 28, further comprising one or more microphones connected to the plurality of input channels.

37. The system according to claim 36, wherein the one or more microphones are two or more microphones, and wherein each of the two or more microphones is spaced between about 1 millimeter and about 1 meter apart.

38. The system according to claim 28, wherein the system is constructed on a hand-held device.

39. The system according to claim 28, wherein the at least one ICA or BSS filter module comprises:

a first adaptive independent component analysis (ICA) filter connected to a first output channel and to a second input channel, the first filter being adapted by a recursive learning rule involving the application of a nonlinear bounded sign function to the one or more noise signals;

a second adaptive independent component analysis filter connected to a first output channel and to a second input channel, the second filter being adapted by a recursive learning rule involving the application of a nonlinear bounded sign function to the desired speech signal;

wherein the first filter and the second filter are repeatedly applied to produce the desired speech signal.

40. The system according to claim 28, wherein the plurality of input channels comprises at least two spaced-apart microphones constructed to receive the acoustic signals, the microphones being an expected distance from a speech source;

wherein the at least one ICA or BSS filter module is coupled to the microphones; and wherein the at least one ICA or BSS filter module is configured to:

receive sound signals from the two microphones; and separate the sound signals under the stability constraint into at least one desired speech output signal line and at least one noise output signal line.

41. The system according to claim 40, further comprising a post-processing filter coupled to the noise output signal line and to the desired speech output signal line.

42. The system according to claim 40, wherein the microphones are spaced about 1 millimeter to about 1 meter apart.

43. The system according to claim 42 further comprising a pre-processing module configured to pre-process the acoustic signals received at each microphone.

44. The system according to claim 40, wherein one of the microphones is on a face of a device housing and another of the microphones is on another face of the device housing.

45. The system according to claim 40, wherein the system is integrated into a speech device.

46. The system according to claim 45, wherein the speech device comprises a wireless phone.

47. The system according to claim 45, wherein the speech device comprises a hands-free car kit.

48. The system according to claim 45, wherein the speech device comprises a headset.

49. The system according to claim 45, wherein the speech device comprises a personal data assistant.

50. The system according to claim 45, wherein the speech device comprises a handheld bar-code scanning device.

* * * * *